US011730247B1

(12) United States Patent
Algabbani et al.

(10) Patent No.: US 11,730,247 B1
(45) Date of Patent: Aug. 22, 2023

(54) COMBINATION HAIR BAND AND COMB

(71) Applicant: KING SAUD UNIVERSITY, Riyadh (SA)

(72) Inventors: Maha Fahad Saud Algabbani, Riyadh (SA); Asma Saad Alrushud, Riyadh (SA); Rawan Faisal Alghamdi, Riyadh (SA); Rahaf Hamad Alrajhi, Riyadh (SA); Ayshah Abdullah Aldosari, Riyadh (SA); Ebtesam Nasser Alqhtaney, Riyadh (SA); Ranym Ibrahim Alawaji, Riyadh (SA); Hala Rashed Alrashed, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 18/115,921

(22) Filed: Mar. 1, 2023

(51) Int. Cl.
*A45D 24/10* (2006.01)
*A45D 8/34* (2006.01)
(Continued)

(52) U.S. Cl.
CPC ..... *A45D 24/10* (2013.01); *A45D 8/34* (2013.01); *A45D 8/36* (2013.01); *A45D 24/04* (2013.01)

(58) Field of Classification Search
CPC .... A45D 2002/003; A45D 2/44; A45D 24/04; A45D 24/36; A01K 13/002;
(Continued)

(56) References Cited

U.S. PATENT DOCUMENTS 3,175,865 A * 3/1965 Herrmann ..... A46B 5/06 15/207.2
5,174,312 A 12/1992 Adams
(Continued)

FOREIGN PATENT DOCUMENTS

CN 108552712 A 9/2018
GB 190804973 A 12/1908

OTHER PUBLICATIONS

Clarivate copywritten translation of Lian (CN202060210U), accessed on May 26, 2023; publication date Dec. 7, 2011 (Year: 2011).*
(Continued)

*Primary Examiner* — Jacqueline T Johanas
*Assistant Examiner* — Sarah Woodhouse
(74) *Attorney, Agent, or Firm* — Nath, Goldberg & Meyer; Richard C. Litman

(57) ABSTRACT

The combination hair band and comb assists people with activities of daily living (ADLs). The combination hair band and comb includes an elongate fabric hair band having a series of small internal combs that assist the user in combing/brushing their hair. A first end of the band is attached to one end of a spring clip, and the opposite second end of the band passes through a hole at the other end of the spring clip. In use, the hair band is tightened by pulling the distal end of the band through the hole in the spring clip. The spring clip is then fastened to maintain the band in the desired position. The internal plastic combs extend through an internal slit in the band and comb the hair as the band is pulled rearward through the user's hair, by the user grasping and pulling the distal end of the band.

11 Claims, 8 Drawing Sheets

(51) Int. Cl.
*A45D 8/36* (2006.01)
*A45D 24/04* (2006.01)

(58) Field of Classification Search
CPC ..... Y10T 24/44274; Y10T 24/44752; A41G 3/0093; F16B 2/22
USPC ..... 119/600, 607, 618, 625, 627, 809, 810; 132/57.1, 59, 60, 63.1, 64.1, 65.1, 66.1, 132/71.1, 213, 213.1, 214, 215, 219, 101, 132/105, 106, 107, 119, 119.1, 123, 126; 2/174
See application file for complete search history.

(56) References Cited

U.S. PATENT DOCUMENTS

| | | | | |
|---|---|---|---|---|
| 5,638,836 | A | 6/1997 | Yasuda | |
| 5,732,720 | A | 3/1998 | Sears | |
| 5,826,593 | A | 10/1998 | Haubrich | |
| 7,013,900 | B2 | 3/2006 | Silva | |
| D864,481 | S | 10/2019 | Kohad | |
| 2009/0090378 | A1* | 4/2009 | Chudzik | A45D 8/36 132/273 |
| 2012/0260935 | A1* | 10/2012 | Lalonde | A45D 8/24 132/273 |
| 2021/0315346 | A1* | 10/2021 | Earhart | A45D 8/36 |
| 2022/0022620 | A1* | 1/2022 | Rubin | A45D 8/34 |

OTHER PUBLICATIONS

Clarivate copywritten translation of Luo (CN204838405U), accessed on May 26, 2023; publication date Dec. 9, 2015 (Year: 2015).*
Clarivate copywritten translation of Droin (FR2769804A1), accessed on May 26, 2023; publication date Apr. 23, 1999 (Year: 1999).*
Clarivate copywritten translation of JP2628124B2, accessed on May 26, 2023; publication date Jul. 9, 1997 (Year: 1997).*
Clarivate copywritten translation of KR200323600Y1, accessed on May 26, 2023; publication date Aug. 19, 2003 (Year: 2003).*
Clarivate copywritten translation of KR200481334Y1, accessed on May 26, 2023; publication date Sep. 13, 2016 (Year: 2016).*
Clarivate copywritten translation of WO99/05933, accessed on May 26, 2023; publication date Feb. 11, 1999 (Year: 1999).*
Sthuahe4PC Multicolor Protection Resin Teeth Comb Hair Hoop Hairband Headband Hair Accessories by Beauty hair, © 1996-2020, Amazon.com, Inc. website: https://www.amazon.com/STHUAHE4PC-Multicolor-Protecci%C3%B3n-Dientes-Accesorios/dp/B07KNMDPSY/ref=asc_df_B07KNMDPSY/?tag=&linkcode=df0&hvadid=309876027486&hvpos=&hvnetw=g&hvrand=7377855401013010975&hvpone=&hvptwo=&hvqmt=&hvdev=c&hvdvcmdl=&hvlocint=&hvlocphy=9007557&hvtargid=pla-668111478209&ref=&adgrpid=61241139&th=1, number of pages = 8.

* cited by examiner

COMBINATION HAIR BAND AND COMB

BACKGROUND

1. Field

The disclosure of the present patent application relates generally to headwear accessories and devices for assisting with activities of daily living (ADLs), and particularly to a combination hair band and comb.

2. Description of the Related Art

Hair brushing and arranging is an activity of daily living (ADL) that many people do themselves to get tidy and professional for work. There are people around the world that find difficulty in performing some ADLs, such as combing and arranging their hair, due to such health conditions as cancer, amputation, and children with hemiplegia. Researchers have found that one-third of adults with cancer have difficulty performing basic ADLs, while half of these adults require assistance to perform instrumental ADLs. People with amputation also have limitations in performing ADLs, with the prevalence of amputations being 1.6 million in 2005, and is expected to double by the year 2050. Those with upper limb amputation have limitations in performing some ADLs, such as combing their hair. Not only adults suffer from difficulty in performing ADLs, but many children also have limitations in performing ADLs. Of those children surviving from stroke, 60% will have hemiparesis, or even hemiplegia, which results in limitations in mobility, and therefore difficulty in performing ADLs.

The available products for assisting people in combing and arranging their own hair axe primarily in two categories, including hair ties, bands, or other devices for holding their hair in place, and hair brushes or combs for assisting in arranging their hair. While there are devices on the market for assisting in hair brushing, these devices tend to require some amount of hand grip. Other options, such as finger-mounted brushes, have only a limited amount of bristles, thereby requiring many strokes to cover the same area, which is not only time consuming, but firing, particularly for the disabled.

Thus, a combination hair band and comb solving the aforementioned problems is desired.

SUMMARY

The combination hair band and comb assists people with activities of daily living (ADLs). The combination hair band and comb includes a comfortable, elongate fabric hair band having a series of small internal combs that assist the user in combing/brushing their hair. A first end of the band is attached to one end of a spring clip, and the opposite second end of the band passes through a hole at the other end of the spring clip. In use, the hair band is tightened by pulling the second end of the band through the hole in the spring clip. The spring clip is then fastened to maintain the band in the desired position. The internal plastic combs extend through an internal slit in the band and comb the hair as the band is pulled rearward through the user's hair, by the user grasping and pulling the second end of the band.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
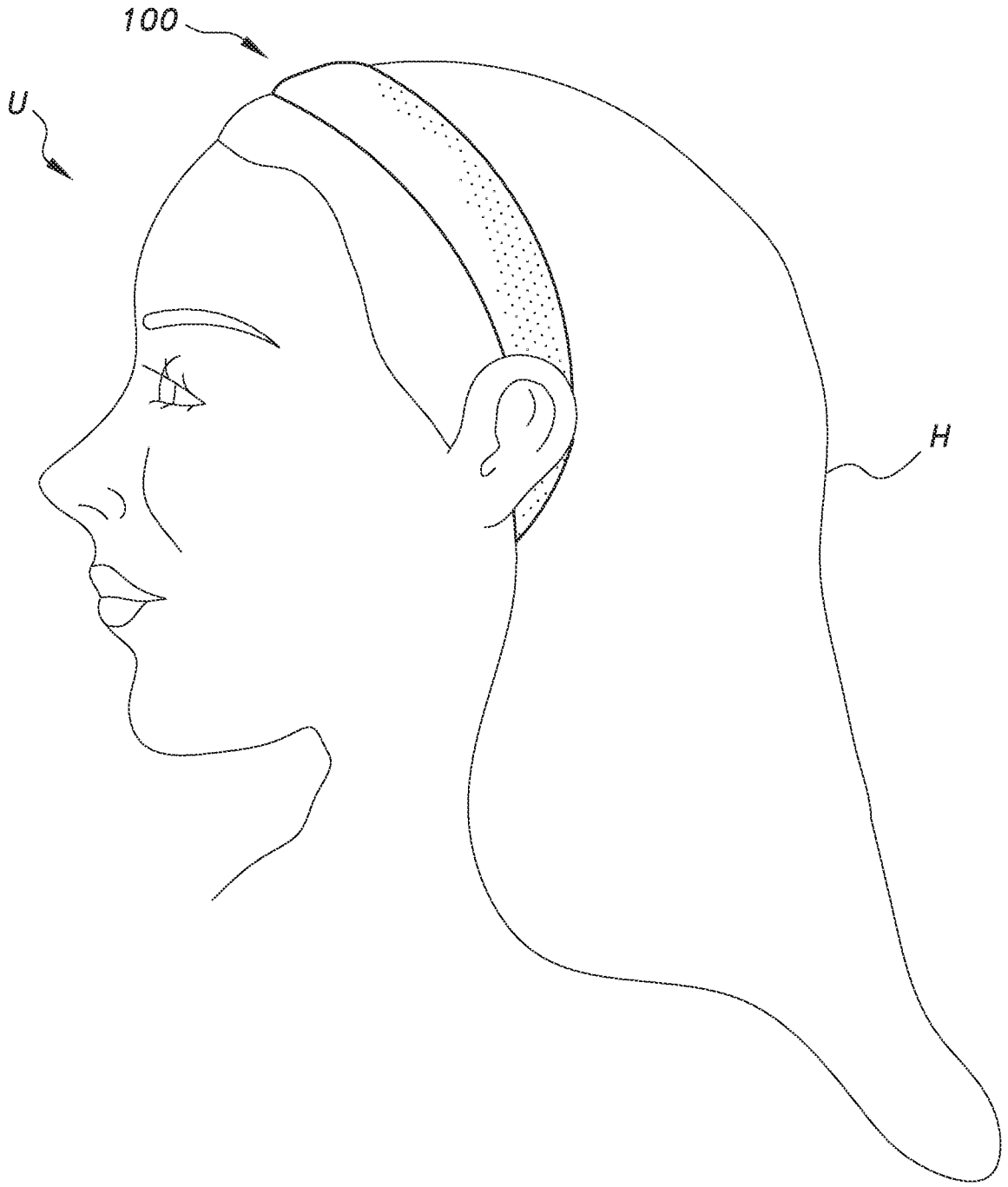
FIG. 1 is an environmental, perspective view of a combination hair band and comb, shown in an initial hair band or combing position.
Figure 2:
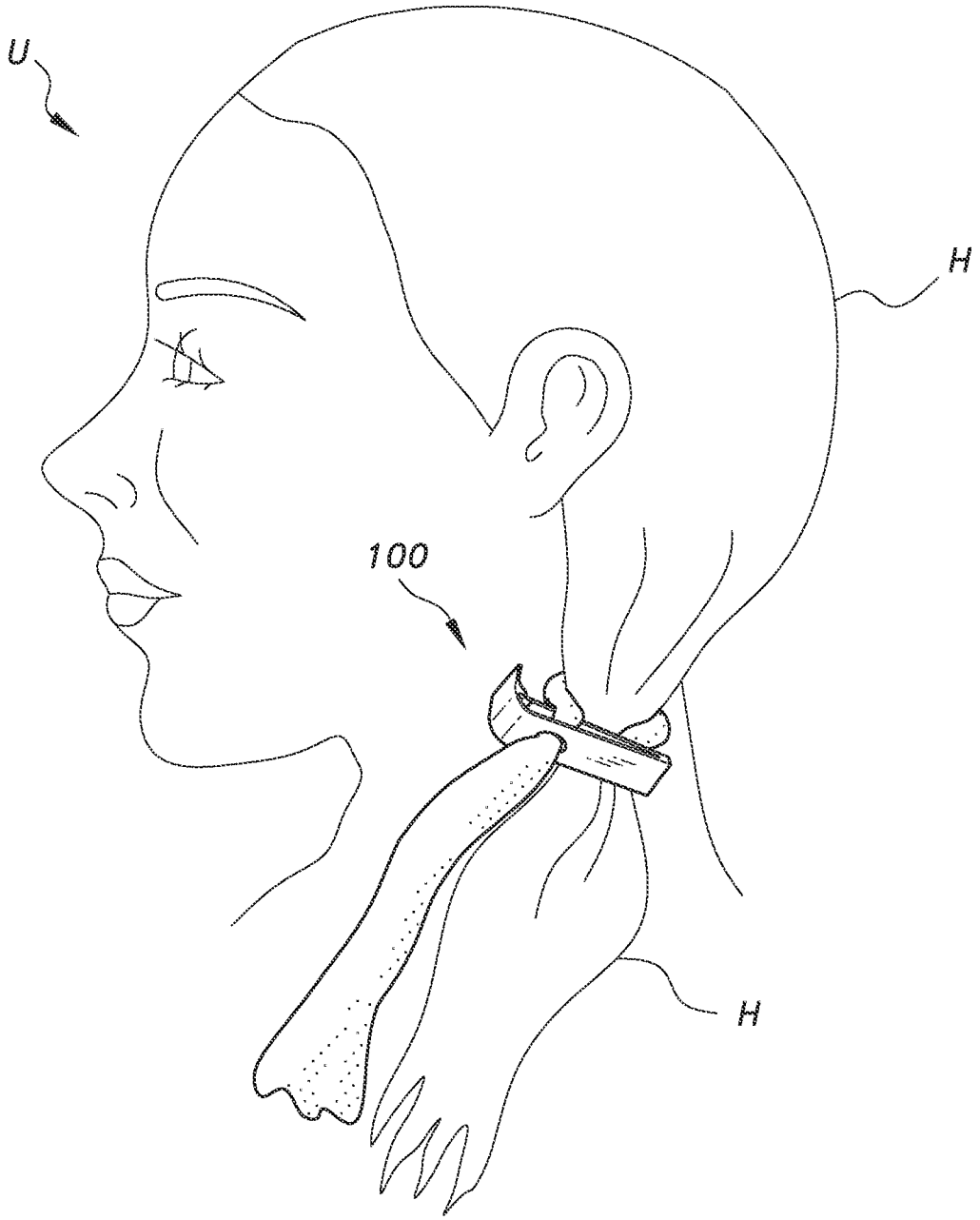
FIG. 2 is an environmental, perspective view of the combination hair band and comb of FIG. 1, shown in a hair tie or intermediate combing position.
Figure 3:
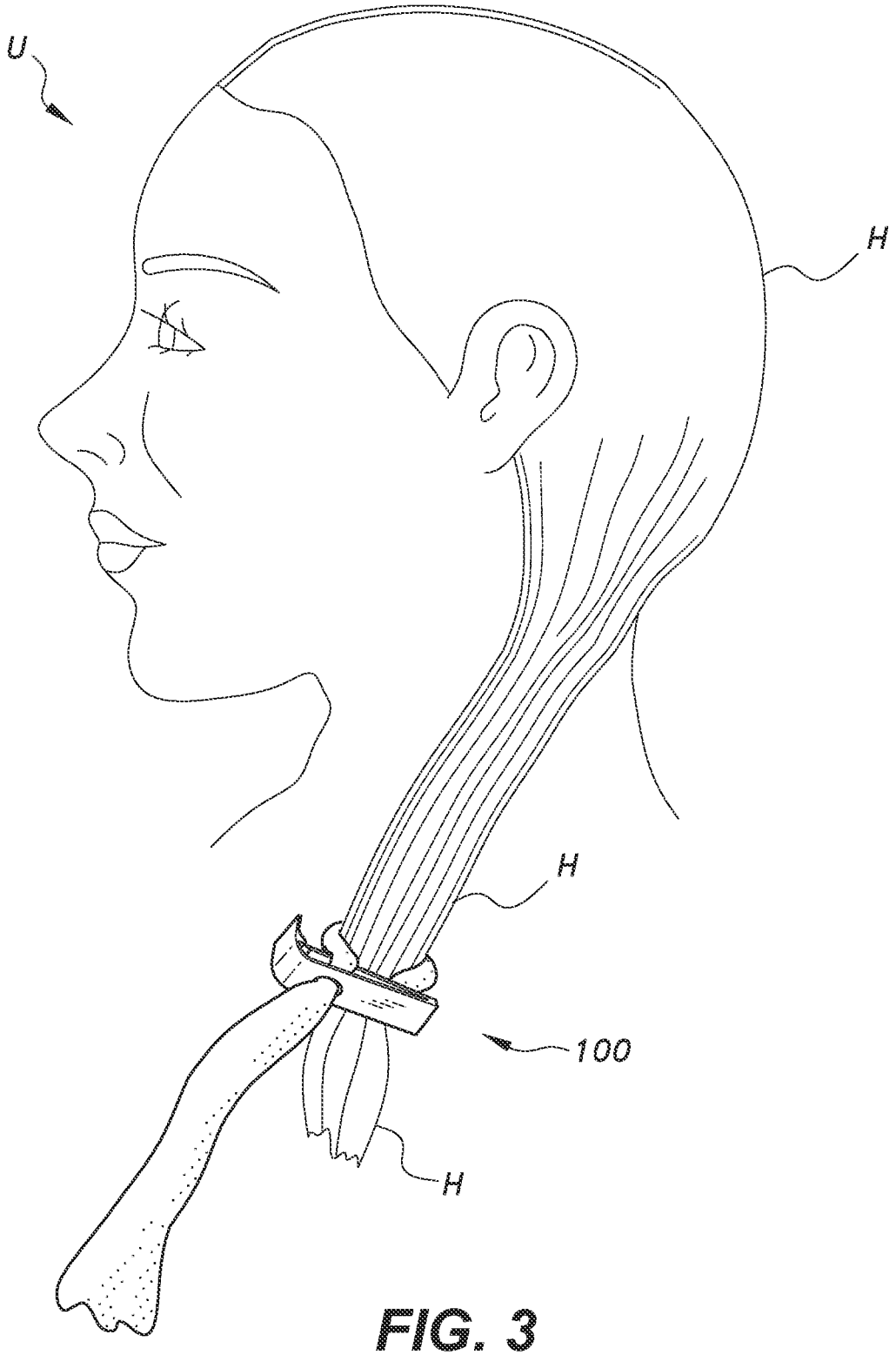
FIG. 3 is an environmental, perspective view of the combination hair band and comb of FIG. 1, shown in another hair tie or combing position.

Referring to FIG. 1, the combination hair band and comb 100 is shown in a first or initial position used as a hair band close to the hairline of a user U and wrapped around her hair H. In this position, the spring clip of the combination hair band and comb 100 may be locked, as described below, to hold the combination hair band and comb 100 in position as a hair band. In FIG. 2, the user has moved the combination hair band and comb 100 until the combination hair band and comb 100 is in a second or intermediate position near the nape of their neck. If the user wants to lock the combination hair band and comb 100 in this position for use as a hair tie, the spring clip may be locked, as described below. In FIG. 3, the user has moved the combination hair band and comb 100 toward the end of the Hair H as a hair tie for a braid.

Figure 4:
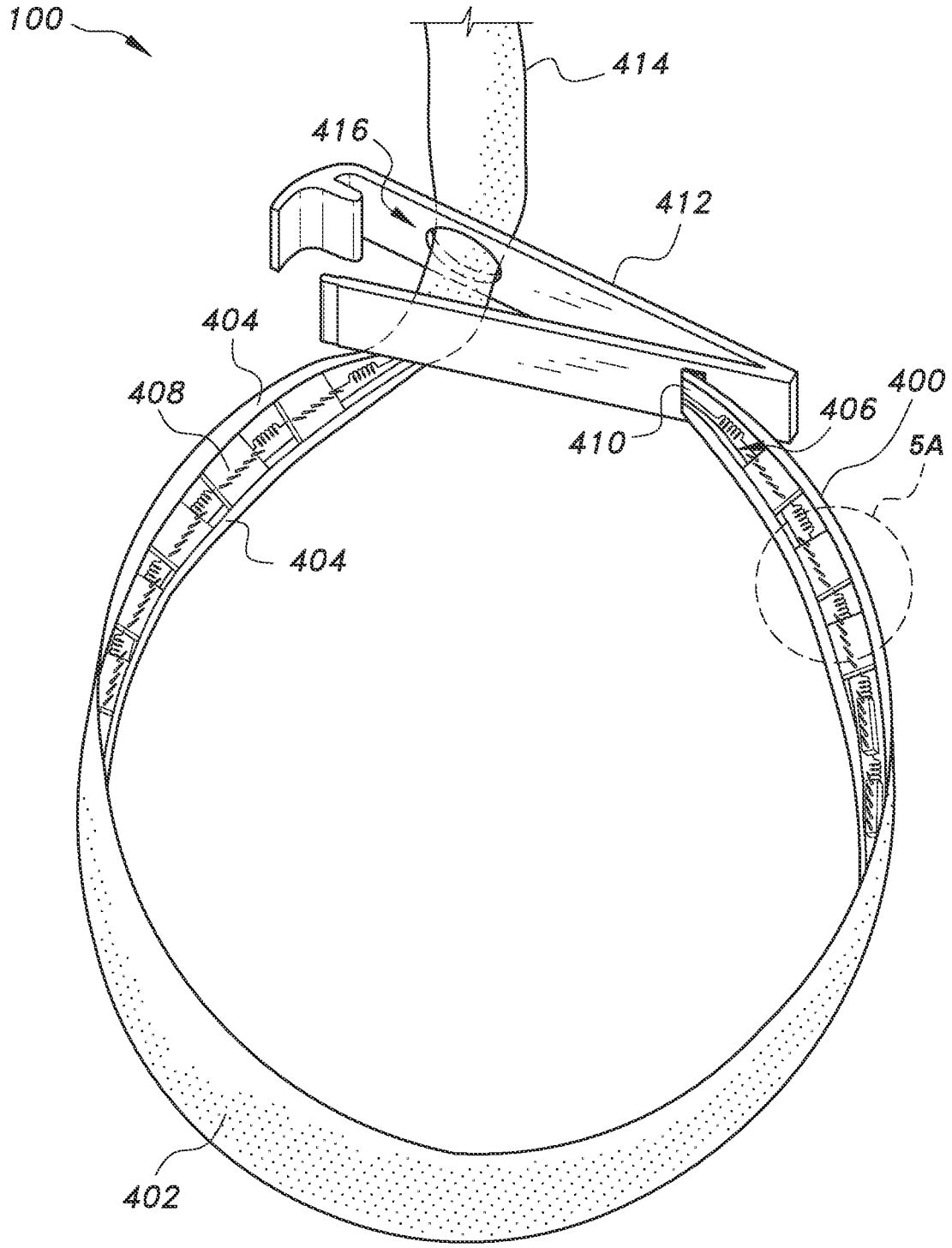
FIG. 4 is a perspective view of the combination hair band and comb of FIG. 1, shown with the combs exposed through a slit in the inner surface of the band.

FIG. 4 shows the combination hair band and comb 100 in an open loop position, exposing the inner surface of the band. FIG. 6 shows a front view of the combination hair band and comb 100. The combination hair band and comb 100 includes a main body in the form of a comfortable, elongate fabric, hair band 400 having an outer surface or fold 402 and an inner surface or folds 404. A slit 406 is formed in the inner surface 404, through which a series of internal, spring-loaded plastic combs 408 extend. The spring-loaded combs 408 are surrounded by cotton and the fabric of the band 400 to protect the user U from the plastic material of the combs 408 and are described in detail with respect to FIGS. 5A-5B, below. A first end 410 of the band 400 is attached to one end of a spring clip 412 and the opposite second end 414 of the band 400 passes through a hole 416 at the other end of the spring clip 412. While the fabric of the band 400 is able to pass through the hole 416, the spring-loaded combs 408 are too large to fit through the hole 416 and therefore become compressed together (FIG. 5B) as the second end 414 of the band 400 is pulled through the hole 416.

Figure 5A:
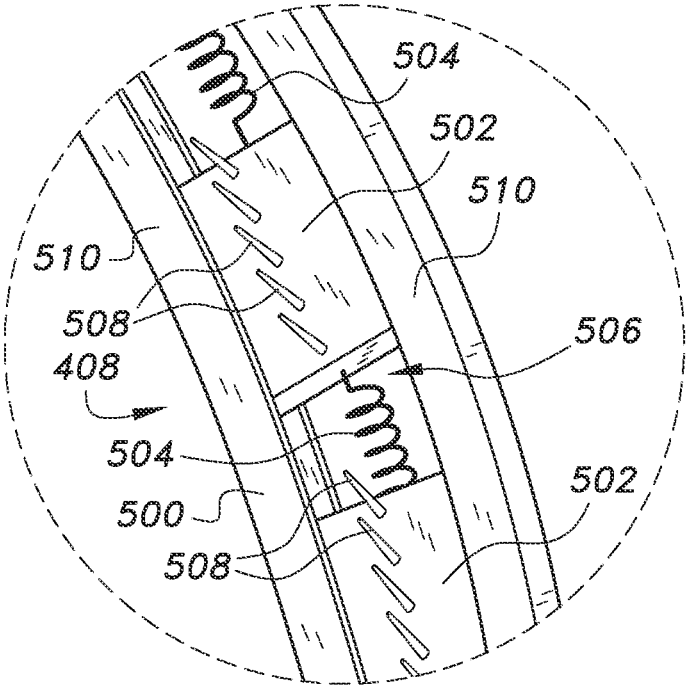
FIG. 5A is a perspective view of a compressible comb assembly of the combination hair band and comb of FIG. 1, showing the comb assembly with the springs uncompressed.
Figure 5B:
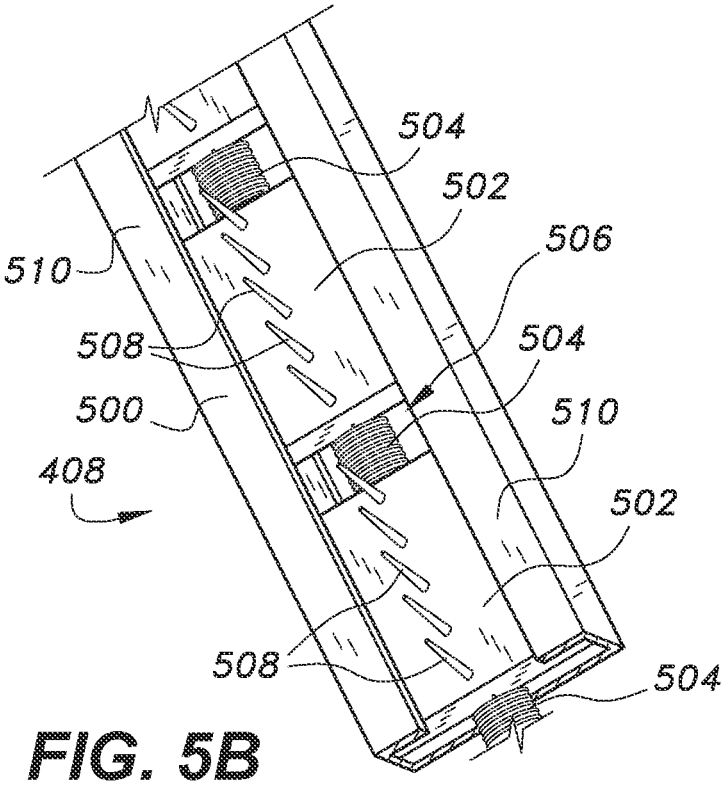
FIG. 5B is a perspective view of the compressible comb assembly of FIG. 5A, showing the comb assembly with the springs compressed as the band is placed under tension.
Figure 6:
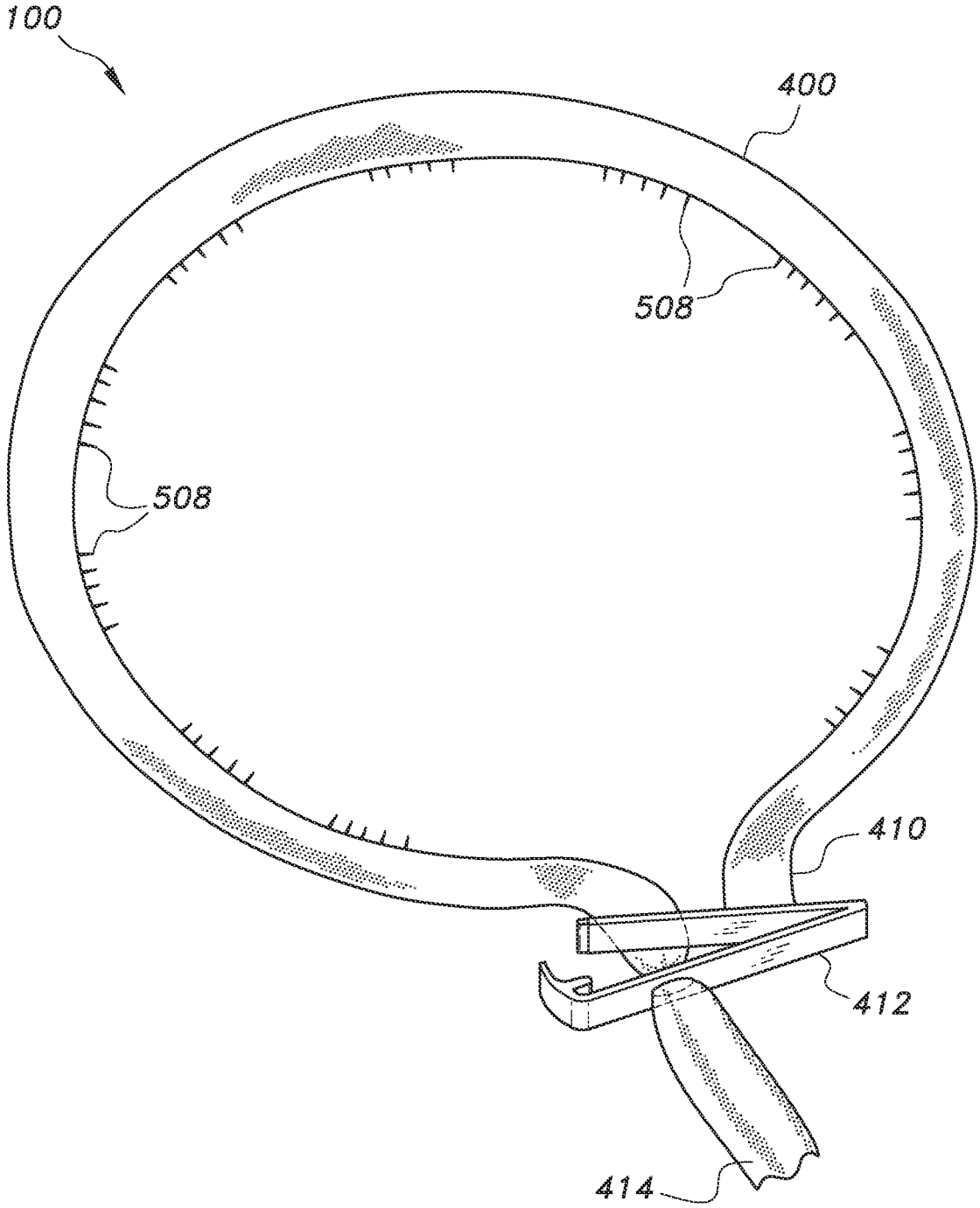
FIG. 6 is a front view of the combination hair band and comb of FIG. 1, shown with the clip unfastened.

The details of the spring-loaded plastic combs 408 are shown in FIGS. 5A-5B. The spring-loaded combs 408 include a plastic bar or housing 500 with a U-shaped cross section and an internal space for housing individual rectangular comb units 502. A series of matched, helical springs 504 maintain an equal spacing between the individual rectangular comb units 502. The width of the rectangular comb units 502 and the diameter of the helical springs 504 are larger than a slot 506 formed by spaced apart retainer flanges extending towards each other across the mouth of the U-shaped cross section of the plastic housing 500, thereby maintaining the rectangular comb units 502 and the helical springs 504 within the housing 500. Each rectangular comb unit 502 includes a plurality of comb teeth 508 extending from the internal surface (as shown) of the comb unit 502 through the slot 506 of the housing 500 to contact the user's U hair H. In FIG. 5A, the spring-loaded plastic combs 408 are shown in a generally uncompressed position, such that the comb units 502 are spaced apart and the springs 504 are generally uncompressed or extended. This position is indicative of the positions of the comb units 502 when the combination hair band and comb 100 is as shown in FIGS. 1 and 4. In FIG. 5B, the spring-loaded plastic combs 408 are shown in a generally compressed position, such that the comb units 502 are pressed together and the springs 504 are generally compressed. This position is indicative of the position of the comb units 502 when the combination hair band and comb 100 is as shown in FIG. 3. The surfaces 510 of the plastic housing 500 facing the band 400 are covered by cotton and the fabric of the band 400 to protect the user U from the plastic materials of the spring-loaded plastic combs 408.

Figure 7:
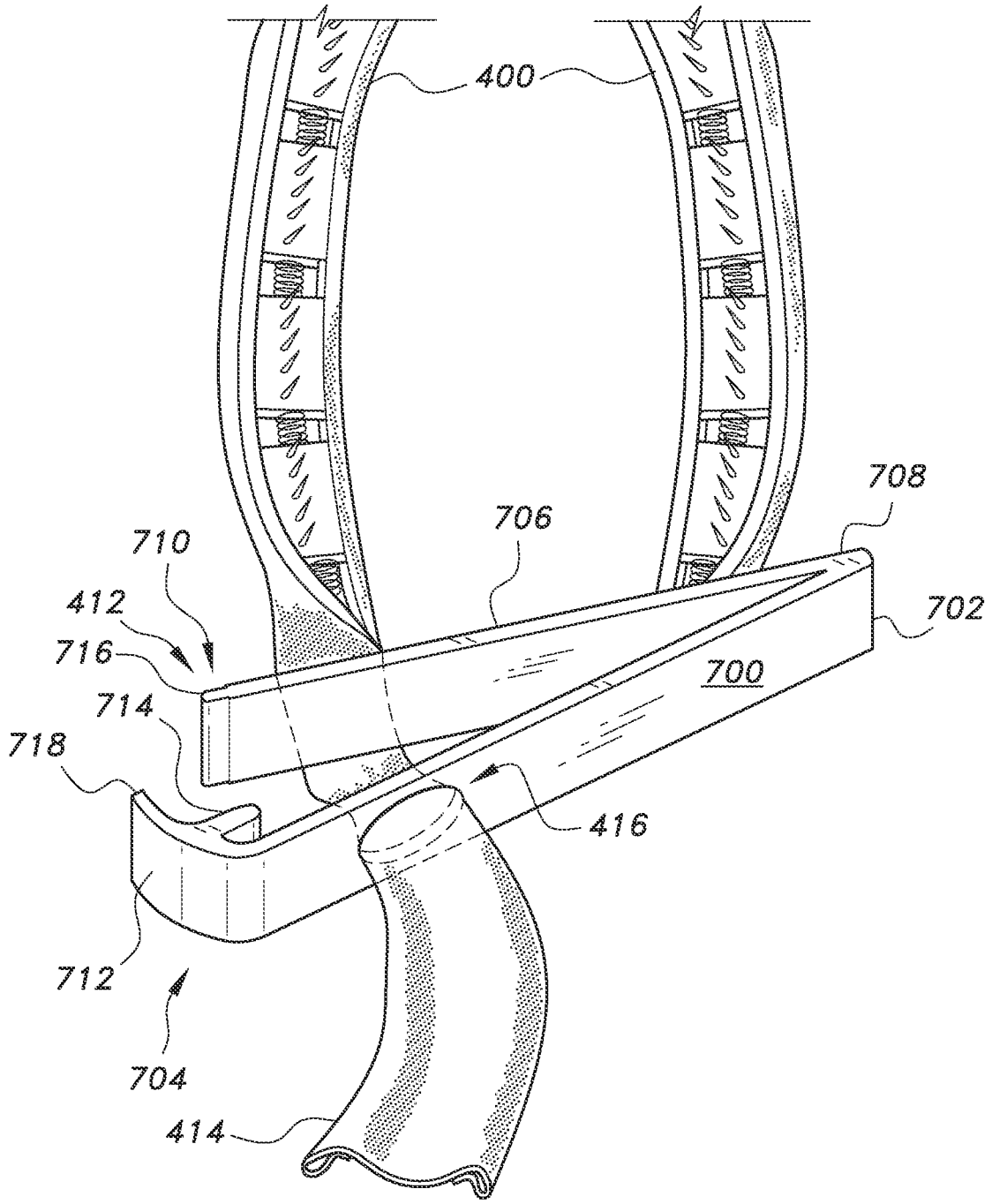
FIG. 7 is a partial perspective view of the combination hair band and comb of FIG. 1, shown with the clip unfastened and the band broken away.
Figure 8A:
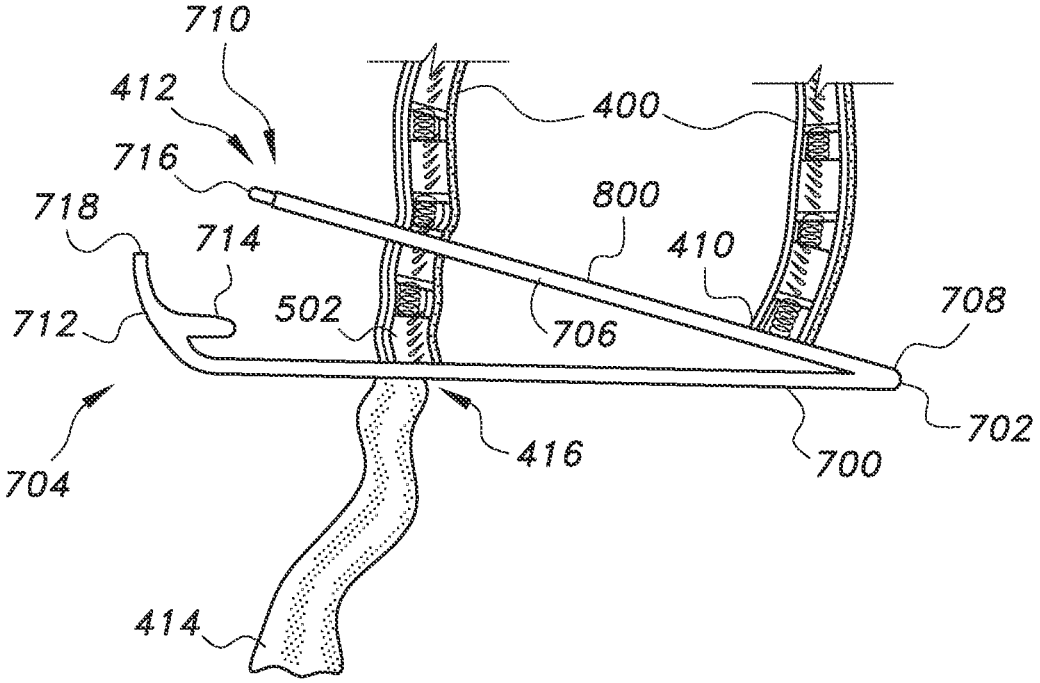
FIG. 8A is a partial perspective view of the combination hair band and comb of FIG. 1, shown with the clip unfastened and the band broken away.
Figure 8B:
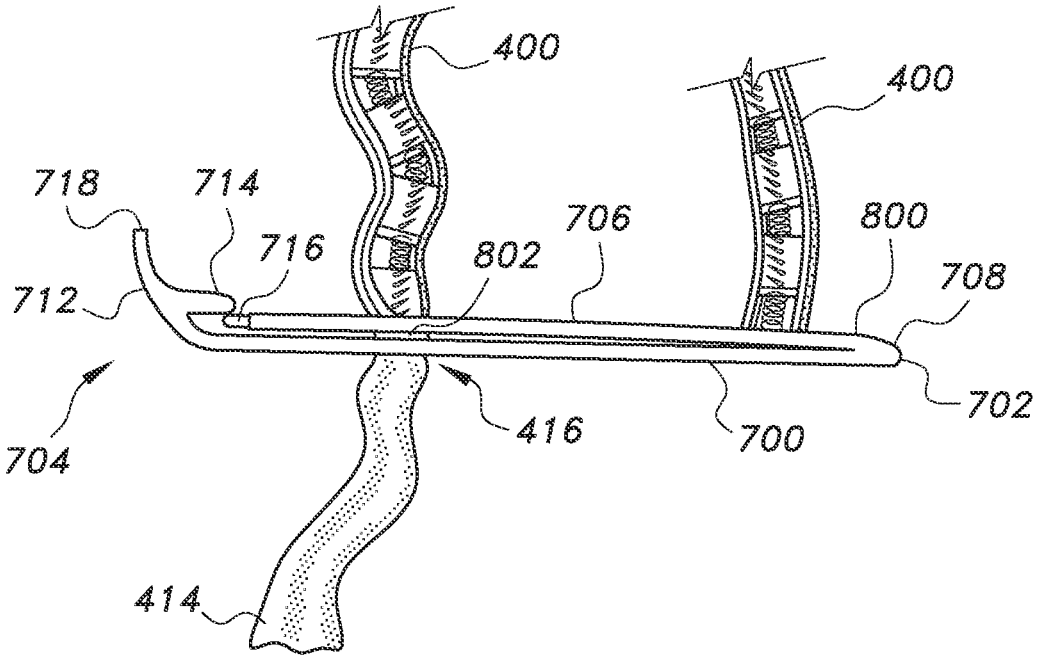
FIG. 8B is a partial perspective view of the combination hair band and comb of FIG. 1, shown with the clip fastened.

FIGS. 7-8B show the details of the spring clip 412. The spring clip 412 is a generally rectangular, planar base plate 700 having a hinged end 702 and an open end 704, and a generally rectangular, planar clamping plate 706 having a hinged end 708 pivotally attached to the hinged end 702 of the base plate 700 and a free end 710. The spring clip 412 is made of a flexible material with memory (such as spring steel), such that the clamping plate 706 is urged into the open position relative to the base plate 700, as shown in FIGS. 7 and 8A. The first end 410 of the band 400 is attached to the upper surface 800 of the clamping plate 706 adjacent its hinged end 708. The second end 414 of the band 400 passes through the hole 416 adjacent the open end 704 of the base plate 700. The open end 704 of the base plate 700 includes a latching member having a main portion 712 that is bent and angled toward the clamping plate 706 and a latching ridge or catch 714 extending from the main portion 712 of the latching member toward the hinged end 702 of the base plate 700. The free end 710 of the clamping plate 706 includes an extension or lip 716. In the open position as shown in FIGS. 7 and 8A, the fabric of the band 400 can pass or be pulled through the hole 416 until the desired position is achieved, as described above with respect to FIGS. 1-3. The comb units 502 cannot pass through the hole 416, as described above. The portion of the second end 414 of the hair band 400 that does pass through the hole 416 is pulled between the base plate 700 and the clamping plate 706. Once the combination hair band and comb 100 is in the desired position, the spring clip 412 is fastened, as shown in FIG. 8B. The lip 716 on the free end 710 of the clamping plate 706 has been snapped under the catch 714 of the base plate 700, thereby keeping the spring clip 412 closed and compressing a portion 802 of the fabric cover of the band 400 between the clamping plate 706 and the base plate 700. To release the lip 716 and open the spring clip 412, a user U applies a small amount of pressure to the tip end 718 of the main portion 712 of the latching member. The spring clip 412 is designed to be opened and closed using only a single finger.

It is to be understood that the combination hair band and comb is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A combination hair band and comb, comprising:

an elongate hair band comprising fabric material and having a first end, a second end, an outer surface, an inner surface, and a slit extending axially in the inner surface of the elongate fabric hair band, the band having an elongate cavity defined between the inner surface and the outer surface;

a plurality of internal, spring-loaded plastic combs extending end to end in the cavity defined in the hair band, each of the combs having teeth extending through the slit defined in the inner surface of the elongate fabric hair band; and a spring clip having a hinged first end, an opposite second end, and a hole defined in the clip adjacent the second end of the clip, the first end of the hair band being attached to the clip adjacent the hinged first end of the clip, the second end of the hair band being extendable through the hole defined in the clip adjacent the second end of the clip;

wherein the plurality of internal, spring-loaded plastic combs are mounted in at least one comb assembly having:

an elongate U-shaped housing defining an elongate internal space and an open mouth, the housing having spaced apart retainer flanges extending towards each other across the open mouth and defining an elongate slot;

a plurality of individual rectangular comb units having sides and ends, the plurality of individual rectangular comb units being arranged end to end in the elongate internal space of the elongate housing; and a plurality of helical springs arranged between the ends of the individual rectangular comb units to maintain an equal spacing between the individual rectangular comb units.

2. The combination hair band and comb as recited in claim 1, wherein each of the rectangular comb units has a width and each of the helical springs has a diameter, the width of the rectangular comb units being larger than the slot in the elongate housing, the retainer flanges maintaining the rectangular comb units and the helical springs within the housing.

3. The combination hair band and comb as recited in claim 2, wherein each of the rectangular comb units further comprises a plurality of comb teeth extending through the slot in the housing and through the slit defined in the inner surface of the elongate fabric hair band.

4. The combination hair band and comb as recited in claim 3, wherein the elongate U-shaped housing is covered by cotton and disposed in the elongate cavity defined between the inner surface and the outer surface of the elongate fabric hairband.

5. The combination hair band and comb as recited in claim 4, wherein the hole defined in the clip adjacent the second end of the clip has a diameter, the spring-loaded combs having an end dimension larger than the diameter of the hole, whereby when the second end of the hair band is pulled through the hole in the clip, the spring-loaded combs are blocked from going through the hole and the helical springs are compressed, reducing space between the individual rectangular comb units.

6. The combination hair band and comb as recited in claim 5, wherein the spring clip further comprises:

a generally rectangular planar base plate having a hinged end and an opposite open end, the hole in the spring clip extending through the base plate adjacent the open end of the base plate; and a generally rectangular, planar clamping plate having a hinged end pivotally attached to the hinged end of the base plate and an opposite free end, the first end of the band being attached to the clamping plate adjacent the hinged end of the clamping plate, the spring clip being made of resilient material and biased into an open position, the free end of the clamping plate and the open end of the base plate being urged apart so that the second end of the band can be pulled through the hole defined in the base plate.

7. The combination hair band and comb as recited in claim 6, wherein:

the open end of the base plate includes a latching member, the latching member having:

a bent main portion angled toward the clamping plate; and a latching catch extending from, the main portion toward the hinged end of the base plate; and the free end of the clamping plate includes a lip, the free end of the clamping plate being pivotal toward the open end of the base plate so that the lip on the free end of the clamping plate is held under the latching catch of the base plate in order to fasten the spring clip, thereby compressing the band between the clamping plate and the base plate so that the band cannot be pulled farther through the hole in the base plate.

8. The combination hair band and comb as recited in claim 7, wherein the lip is releasable from the latching catch of the base plate by applying pressure to a tip end of the main portion of the latching member.

9. The combination hair band and comb as recited in claim 1, wherein the spring clip further comprises:

a generally rectangular planar base plate having a hinged end and an opposite open end, the hole in the spring clip extending through the base plate adjacent the open end of the base plate; and a generally rectangular, planar clamping plate having a hinged end pivotally attached to the hinged end of the base plate and an opposite free end, the first end of the band being attached to the clamping plate adjacent the hinged end of the clamping plate, the spring clip being made of resilient material and biased into an open position, the free end of the clamping plate and the open end of the base plate being urged apart so that the second end of the band can be pulled through the hole defined in the base plate.

10. The combination hair band and comb as recited in claim 9, wherein:

the open end of the base plate includes a latching member, the latching member having:

a bent main portion angled toward the clamping plate; and a latching catch extending from the main portion toward the hinged end of the base plate; and the free end of the clamping plate includes a lip, the free end of the clamping plate being pivotal toward the open end of the base plate so that the lip on the free end of the clamping plate is held under the latching catch of the base plate in order to fasten the spring to clip, thereby compressing the band between the clamping plate and the base plate so that the band cannot be pulled farther through the hole in the base plate.

11. The combination hair band and comb as recited in claim 10, wherein the lip is releasable from the latching catch of the base plate by applying pressure to a tip end of the main portion of the latching member.

* * * * *